US008665297B2

(12) United States Patent
Park et al.

(10) Patent No.: US 8,665,297 B2
(45) Date of Patent: Mar. 4, 2014

(54) DISPLAY APPARATUS HAVING TEMPERATURE SENSOR AND METHOD OF DRIVING THE SAME

(75) Inventors: Bongim Park, Asan-si (KR); Nam-Gon Choi, Asan-si (KR); ByungKil Jeon, Asan-si (KR); Jae-Won Jeong, Seoul (KR); Woo-Young Lee, Daegu (KR); Kang-Hyun Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 825 days.

(21) Appl. No.: 12/756,682

(22) Filed: Apr. 8, 2010

(65) Prior Publication Data

US 2011/0057959 A1 Mar. 10, 2011

(30) Foreign Application Priority Data

Sep. 9, 2009 (KR) ..... 10-2009-0085081

(51) Int. Cl.
*G09G 5/10* (2006.01)

(52) U.S. Cl.
USPC ..... 345/690; 345/88

(58) Field of Classification Search
USPC ..... 345/690, 88, 89, 691
See application file for complete search history.

(56) References Cited

U.S. PATENT DOCUMENTS

| | | | | |
|---|---|---|---|---|
| 6,215,468 | B1 * | 4/2001 | Van Mourik | 345/605 |
| 6,862,012 | B1 * | 3/2005 | Funakoshi et al. | 345/88 |
| 2001/0038372 | A1 * | 11/2001 | Lee | 345/89 |
| 2003/0107546 | A1 * | 6/2003 | Ham | 345/101 |
| 2003/0179170 | A1 * | 9/2003 | Lee | 345/87 |
| 2004/0189657 | A1 * | 9/2004 | Ikeda et al. | 345/589 |
| 2005/0024382 | A1 * | 2/2005 | Ho et al. | 345/601 |
| 2005/0110809 | A1 * | 5/2005 | Tung et al. | 345/690 |
| 2006/0044249 | A1 * | 3/2006 | Lee et al. | 345/98 |
| 2006/0055828 | A1 * | 3/2006 | Henry et al. | 348/674 |
| 2006/0061828 | A1 * | 3/2006 | Park | 358/300 |
| 2006/0092110 | A1 * | 5/2006 | Park | 345/87 |
| 2006/0103682 | A1 * | 5/2006 | Kunimori et al. | 345/690 |
| 2006/0158415 | A1 * | 7/2006 | Izumi | 345/98 |
| 2006/0250346 | A1 * | 11/2006 | Ham | 345/101 |
| 2007/0075951 | A1 * | 4/2007 | Lin et al. | 345/89 |
| 2007/0285349 | A1 * | 12/2007 | Hong et al. | 345/38 |
| 2008/0084432 | A1 * | 4/2008 | Jeon | 345/690 |
| 2008/0198122 | A1 * | 8/2008 | Shin et al. | 345/94 |
| 2009/0040167 | A1 * | 2/2009 | Sun | 345/99 |

FOREIGN PATENT DOCUMENTS

| | | | |
|---|---|---|---|
| CN | 1573451 | A | 2/2005 |
| CN | 1744189 | A | 3/2006 |
| CN | 1746962 | A | 3/2006 |
| CN | 1804986 | A | 7/2006 |
| CN | 101266770 | A | 9/2008 |
| CN | 101276561 | A | 10/2008 |
| JP | 04288589 | A | 10/1992 |
| JP | 10-039837 | | 2/1998 |
| JP | 2005004203 | A | 1/2005 |
| JP | 2006079043 | A | 3/2006 |
| KR | 10-0853210 | | 9/2003 |
| KR | 10-2006-0128554 | | 12/2006 |

* cited by examiner

*Primary Examiner* — Chanh Nguyen
*Assistant Examiner* — Robert Stone
(74) *Attorney, Agent, or Firm* — Cantor Colburn LLP

(57) ABSTRACT

A display apparatus includes a temperature sensor, a timing controller, a data driver and a display panel. The temperature sensor senses a temperature, the timing controller includes a dynamic capacitance capture ("DCC") block, which converts a green data, a red data and a blue data into a green compensation data, a red compensation data and a blue compensation data, respectively, based on the temperature sensed by the temperature sensor, and the data driver converts the red compensation data, the green compensation data and the blue compensation data into a data voltage and outputs the data voltage. The display panel receives the data voltage and displays an image.

12 Claims, 11 Drawing Sheets

DISPLAY APPARATUS HAVING TEMPERATURE SENSOR AND METHOD OF DRIVING THE SAME

This application claims priority to Korean Patent Application No. 2009-85081, filed on Sep. 9, 2009, and all the benefits accruing therefrom under 35 U.S.C. §119, the content of which in its entirety is herein incorporated by reference.

BACKGROUND OF THE INVENTION (1) Field of the Invention

The following description relates to a display apparatus and a method of driving the display apparatus. More particularly, the following description relates to a display apparatus which effectively prevents a color blurring phenomenon and a method of driving the display apparatus.

(2) Description of the Related Art

A liquid crystal display typically includes two substrates facing each other and a liquid crystal layer interposed between the two substrates.

The liquid crystal display is widely used in various electric appliances, such as a computer monitor, a television set and other similar electric appliances which display moving images, for example. However, the liquid crystal display has disadvantages when displaying moving images, due to a slow response speed of liquid crystal molecules in the liquid crystal layer. Accordingly, various schemes have been suggested to improve the response speed of the liquid crystal molecules. In addition, a color compensation scheme has been developed to improve color characteristics of the liquid crystal display.

However, when the abovementioned schemes are applied together in a liquid crystal display, a color blurring phenomenon occurs, due to a response speed difference among pixels.

BRIEF SUMMARY OF THE INVENTION

Exemplary embodiments of the present invention relate to a display apparatus which effectively reduces a response speed difference between pixels and thereby prevents color blurring phenomenon.

Exemplary embodiments of the present invention also relate to a method of driving the display apparatus.

In exemplary embodiments of the present invention, a display apparatus includes a temperature sensor, a timing controller, a data driver and a display panel. The temperature sensor senses a temperature. The timing controller includes a dynamic capacitance capture ("DCC") block which converts a green data, a red data and a blue data into a green compensation data, a red compensation data and a blue compensation data, respectively, based on the temperature sensed by the temperature sensor.

The data driver converts the red compensation data, the green compensation data and the blue compensation data into a data voltage and outputs the data voltage. The display panel receives the data voltage and displays an image.

In exemplary embodiments of the present invention, a method of driving a display apparatus includes sensing a temperature, converting a green data, a red data and a blue data into a green compensation data, a red compensation data and a blue compensation data, respectively, based on the temperature, converting the red compensation data, the green compensation data and the blue compensation data into a data voltage, and receiving the data voltage and displaying an image based on the data voltage.

In exemplary embodiments, the DCC block compensates for each of the red, green and blue data based on different correction values, thus a response speed difference between red, green and blue sub-pixels is substantially decreased. Accordingly, a color blurring phenomenon on a screen of the display apparatus is effectively prevented.

BRIEF DESCRIPTION OF THE DRAWINGS

The above and other aspects and features of the present invention will become more apparent by describing in further detail exemplary embodiments thereof with reference to the accompanying drawings, in which.

DETAILED DESCRIPTION OF THE INVENTION

Figure 1:
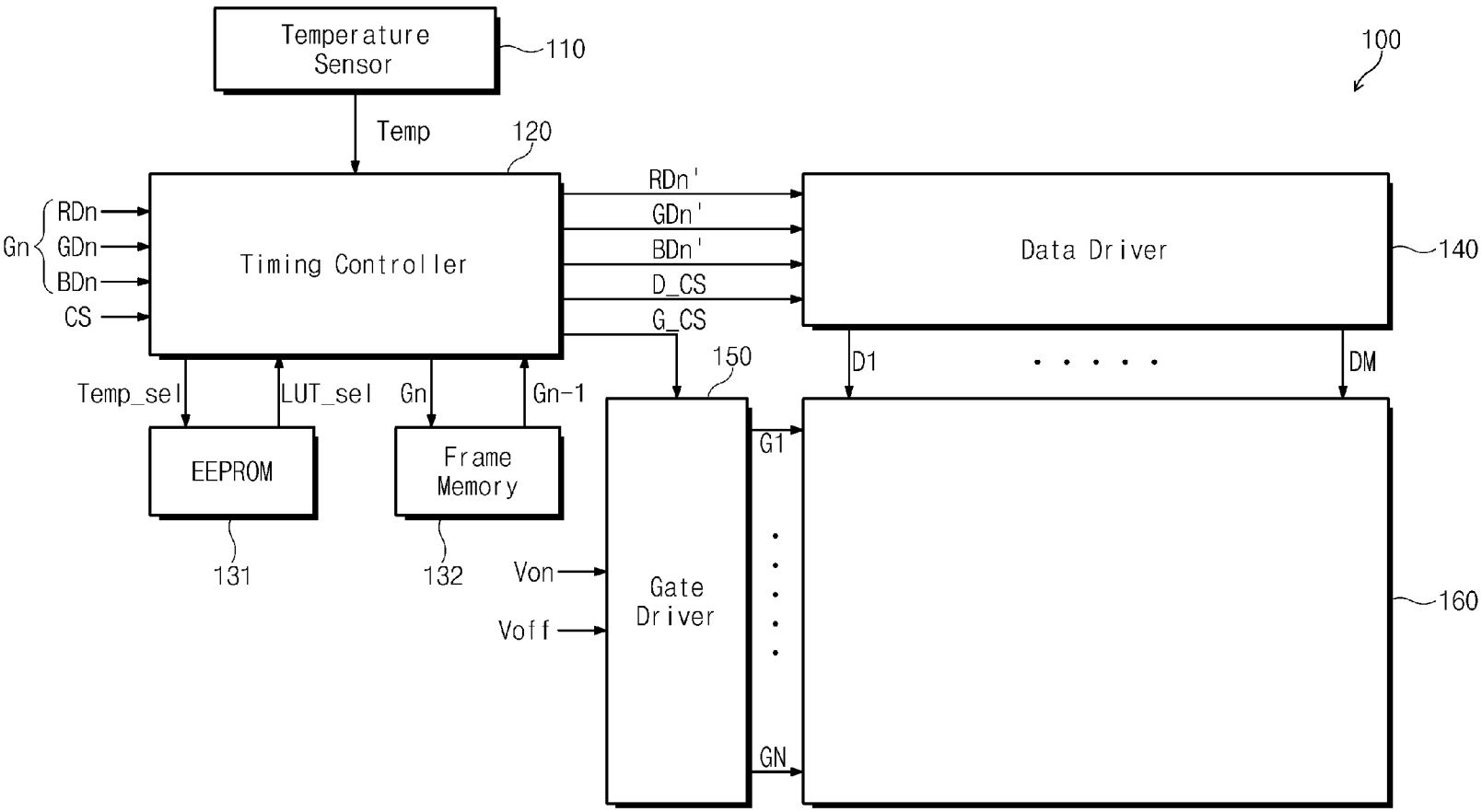
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

Figure 2:
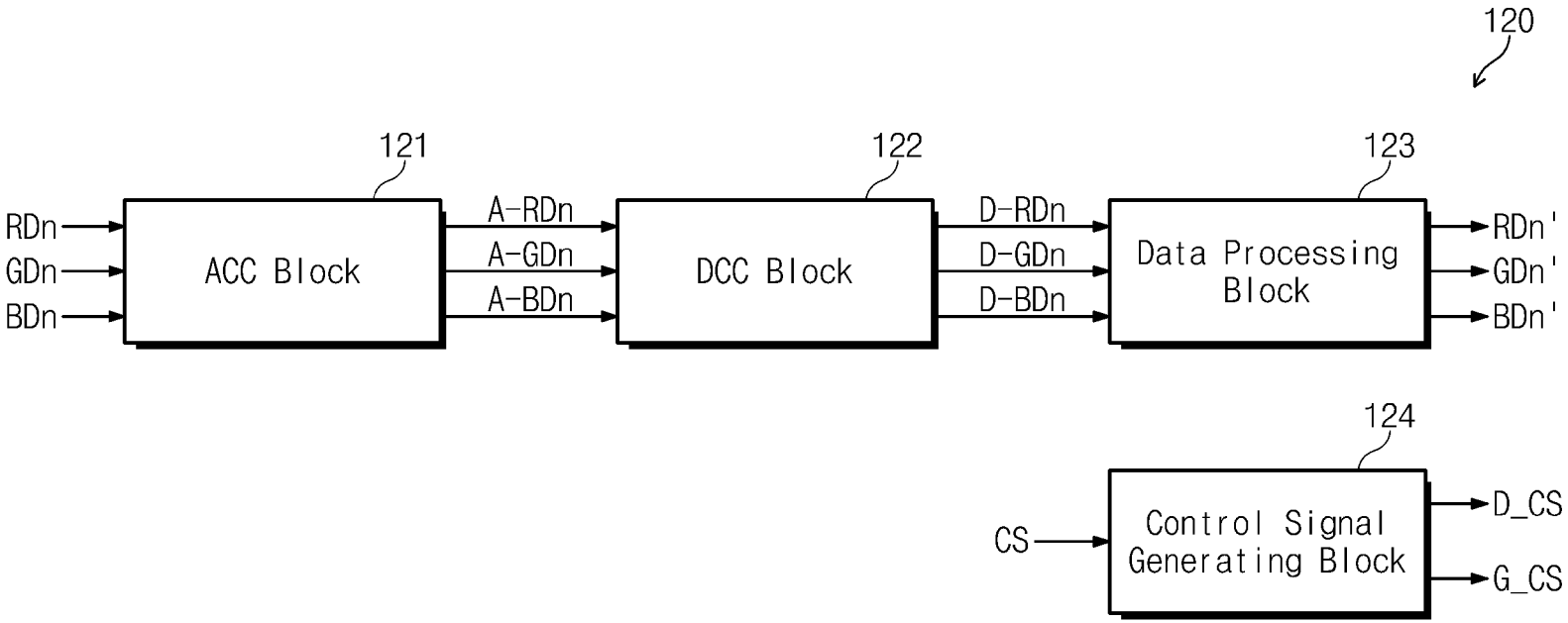
FIG. 2 is a block diagram of an exemplary embodiment of a timing controller of the display apparatus of FIG. 1.

FIG. 1 is a block diagram of an exemplary embodiment of a display apparatus according to the present invention, and FIG. 2 is a block diagram of an exemplary embodiment of a timing controller of the display apparatus of FIG. 1.

As shown in FIG. 1, a display apparatus 100 includes a temperature sensor 110, a timing controller 120, an electrically erasable programmable read-only memory ("EEPROM") 131, a frame memory 132, a data driver 140, a gate driver 150 and a display panel 160.

The temperature sensor 110 senses an ambient temperature and provides a temperature data Temp corresponding to the ambient temperature to the timing controller 120.

The timing controller 120 receives a control signal CS and a present image signal Gn from an external source (not shown). The present image signal Gn includes red data RDn, green data GDn and blue data BDn. When the present image signal Gn is provided to the timing controller 120, the timing controller 120 reads out a previous image signal Gn-1 from the frame memory 132 and writes the present image signal Gn in the frame memory 132.

As shown in FIG. 2, the timing controller 120 includes an accurate color capture ("ACC") block 121, a dynamic capacitance capture ("DCC") block 122, a data processing block 123 and a control signal generating block 124.

The ACC block 121 performs gamma corrections on the red, green and blue data RDn, GDn and BDn based on gamma correction values determined according to gamma characteristics of the display apparatus 100, and outputs corrected red, green and blue data A-RDn, A-GDn and A-BDn, respectively. When red, green and blue gamma characteristics of the display apparatus 100 are different from one another, a brightness of the red data RDn, a brightness of the green data GDn and a brightness of blue data BDn are different from one another for a given corresponding, e.g., same, gray scale value. In an exemplary embodiment, the brightness of the blue data BDn is high (relative to the red and green data), the brightness of the red data RDn is relatively low, and the brightness of the green data GDn is intermediate between the brightness of the blue data BDn and the brightness of the red data RDn.

To compensate for the brightness differences among the red, green and blue data RDn, GDn and BDn, respectively, the ACC block 121 sets a reference gamma characteristic (e.g., a gamma value of 2.2) and sets differences between the reference gamma characteristic and each of the red, green and blue gamma characteristics for every gray scale values as the gamma correction values. Accordingly, the gamma correction values corresponding to the red, green and blue data RDn, GDn and BDn may be added to or subtracted from the red, green and blue data RDn, GDn and BDn by the ACC block 121, and the brightness differences are thereby compensated.

Figure 3:
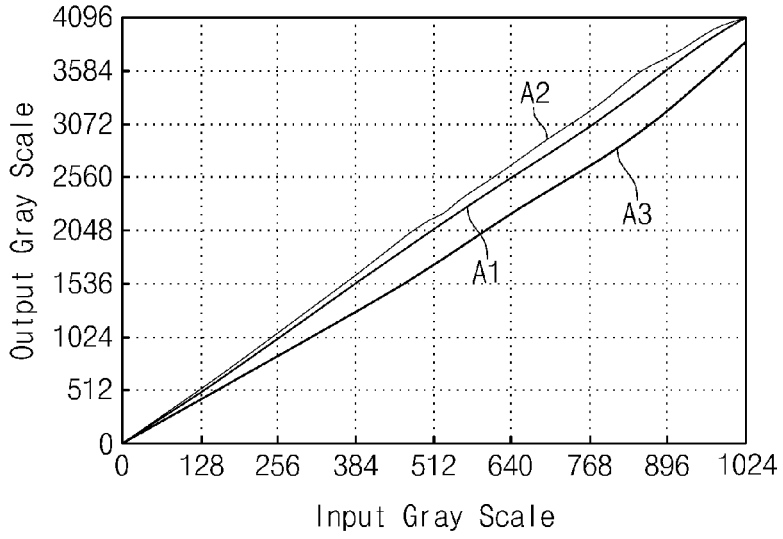
FIG. 3 is a graph of output gray scale versus input gray scale showing output gray scale values of corrected red, green and blue data versus input gray scale values of red, green and blue data of an accurate color capture ("ACC") block of the timing controller of FIG. 2.

FIG. 3 is a graph of output gray scale versus input gray scale showing output gray scale value of corrected red, green and blue data versus input gray scale value of red, green and blue data of the ACC block of the timing controller of FIG. 2. In FIG. 3, a first graph A1 indicates the output gray scale values according to the input gray scale values of the green data, a second graph A2 indicates the output gray scale values according to the input gray scale values of the red data, and a third graph A3 indicates the output grays scale values according to the input grays scale values of the blue data.

As shown in FIG. 3, although the red, green and blue data RDn, GDn and BDn in a same gray scale value are provided to the ACC block 121, the ACC block 121 compensates for the red, green and blue data RDn, GDn and BDn to have different gray scale values, and thereby substantially decreases the brightness difference. FIG. 3 shows an example that the red, green and blue data RDn, GDn and BDn expand bit numbers thereof by the compensation of the ACC block 121, which are greater than bit numbers before the red, green and blue data RDn, GDn and BDn are input to the ACC block 121. In an exemplary embodiment, the ACC block 121 may receive the red, green and blue data RDn, GDn and BDn having 512 gray scale level and outputs the corrected green data A-GDn having 2048 gray scale level, the corrected red data A-RDn having gray scale level higher than 2048 gray scale level, and the corrected blue data A-BDn having gray scale level lower than 2048 gray scale level. Thus, white color coordinates according to the corrected red, green and blue data A-RDn, A-GDn and A-BDn is substantially uniformly maintained with respect to all gray scale levels, and thereby color characteristics of the display apparatus 100 are substantially improved.

In an exemplary embodiment, to improve the response speed of a present frame, the DCC block 122 shown in FIG. 2 compensates for the gray scale values of the present image signal Gn based on correction values that are determined according to the gray scale difference between the present image signal Gn and the previous image signal Gn-1. In an exemplary embodiment, the DCC block 122 increases the gray scale value of the present image signal Gn above target gray scale levels. In an exemplary embodiment, the DCC block 122 may compensate for the response speed of each of the corrected red, green and blue data A-RDn, A-GDn and A-BDn that have been color-compensated by the ACC block 121.

To this end, the EEPROM 131 may store a red look-up table including a red correction value used to compensate the corrected red data A-RDn, a green look-up table including a green correction value used to compensate the corrected green data A-GDn, and a blue look-up table including a blue correction value used to compensate the corrected blue data A-BDn. Accordingly, the DCC block 122 converts the corrected red data A-RDn into red compensation data D-RDn by compensating for the corrected red data A-RDn based on the red correction value of the red look-up table, converts the corrected green data A-GDn into green compensation data D-GDn by compensating for the corrected green data A-GDn based on the green correction value of the green look-up table, and converts the corrected blue data A-BDn into blue compensation data D-BDn by compensating for the corrected blue data A-BDn based on the blue correction value of the blue look-up table.

In an exemplary embodiment, when the response speed of the display apparatus 100 varies according to temperature change, the red, green and blue correction values may be set different from one another according to the temperature data Temp output from the temperature sensor 110. In an exemplary embodiment, when the response speed of the display apparatus 100 becomes faster as the temperature increases, each of the red, green and blue correction value decreases, and when the response speed of the display apparatus 100 becomes slower as the temperature decreases, the each of the red, green and blue correction value increases.

Figure 4:
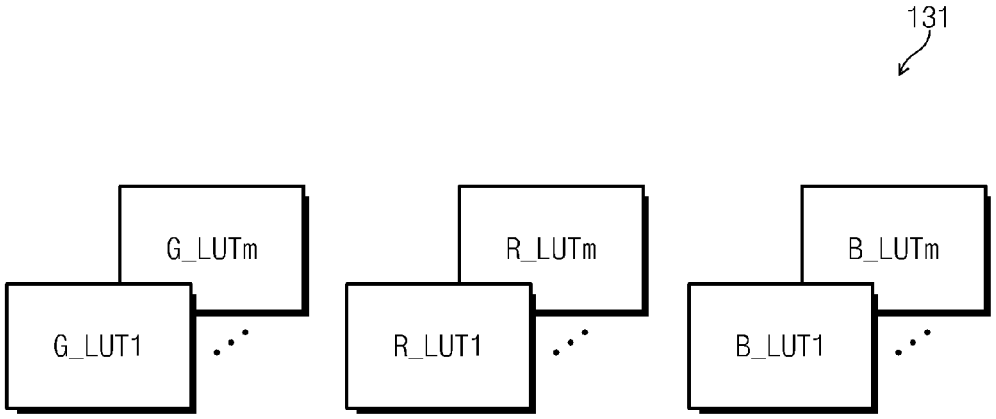
FIG. 4 is a plan view of an exemplary embodiment of an electrically erasable programmable read-only memory ("EEPROM") of the display apparatus of FIG. 1.

FIG. 4 is a plan view of an exemplary embodiment of the EEPROM of the display apparatus of FIG. 1.

As shown in FIG. 4, the EEPROM 131 may include red look-up tables, e.g., a first red look-up table to an m-th red look-up table R_LUT1 to R_LUTm, including red correction values different from one another according to predetermined temperatures, green look-up tables, e.g., a first green look-up table to an m-th green look-up table G_LUT1 to G_LUTm, including green correction values different from one another according to the predetermined temperatures, and blue look-up tables, e.g., a first blue look-up table to an m-th blue look-up table B_LUT1 to B_LUTm, including blue correction values different from one another according to the predetermined temperatures. In an exemplary embodiment, the timing controller 120 generates a selection signal Temp_sel corresponding to the temperature data Temp provided from the temperature sensor 110, and thereby selects one of the red look-up tables, e.g., one of the first red look-up table to the m-th red look-up table R_LUT1 to R_LUTm, one of the green look-up table, e.g., one of the first green look-up table to the m-th green look-up table G_LUT1 to G_LUTm, and one of the blue look-up table, e.g., one of the first blue look-up table to the m-th blue look-up table B_LUT1 to B_LUTm. In an exemplary embodiment, the DCC block 122 may compensate for the corrected red, green and blue data A-RDn, A-GDn and A-BDn with reference to the one of the red, green and blue look-up tables selected by the timing controller 120, e.g., a selected red look-up table R_LUT_sel, a selected green look-up table G_LUT_sel and a selected blue look-up table B_LUT_sel.

The DCC block 122 will be described in greater detail below with reference to FIGS. 4 to 10.

The data processing block 123 generates converted red, green and blue data RDn', GDn' and BDn' by converting a data format of each of the red, green and blue compensation data D-RDn, D-GDn and D-BDn generated by the DCC block 122 and provides the converted red, green and blue data RDn', GDn' and BDn' to the data driver 140.

The control signal generating block 124 generates a data control signal D_CS and a gate control signal G_CS based on the control signal CS received from an external source. The control signal CS may include a vertical synchronizing signal, a horizontal synchronizing signal, a main clock, a data enable signal and other similar signals, for example.

Referring again to FIG. 1, the data control signal D_CS serves as a signal that controls a drive of the data driver 140 and is provided to the data driver 140. The data control signal D_CS may include a horizontal start signal that starts a driving of the data driver 140, an inversion signal that inverts a polarity of data voltages, and an output indicating signal that decides an output timing of the data voltages from the data driver 140.

The gate control signal G_CS is a signal that controls a driving of the gate driver 150 and is provided to the gate driver 150. The gate control signal G_CS may include a vertical start signal that starts the drive of the gate driver 150, a gate clock signal that determines an output timing of a gate pulse, and an output enable signal that determines a pulse width of the gate pulse.

The data driver 140 receives the converted red, green and blue data RDn', GDn' and BDn' in synchronization with the data control signal D_CS from the timing controller 120. The data driver 140 receives gamma reference voltages generated by a gamma reference voltage generator (not shown) and converts the converted red, green and blue data RDn', GDn' and BDn' into the data voltages, e.g., a first data voltage to an m-th data voltage D1 to Dm, respectively, based on the gamma reference voltages.

The gate driver 150 receives a gate-on voltage Von and a gate-off voltage from a voltage generator (not shown) and outputs gate signals, e.g., a first gate signal to an m-th gate signal G1 to Gn, respectively, which swing between the gate-on voltage Von and the gate-off voltage Voff in synchronization with the gate control signal D_CS from the timing controller 120.

The display panel 160 includes pixels, and the pixels respond to the gate signals, e.g., the first gate signal to the m-th gate signal G1 to Gn, to provide the data voltage, e.g., the first data voltage to the m-th data voltage D1 to Dm to pixels disposed in a corresponding pixel row. Accordingly, each of the pixels disposed in the corresponding pixel row is charged with corresponding data voltages, light transmittance of a liquid crystal layer is controlled according to the level of the charged data voltages, and thereby the display panel displays predetermined images on the display panel 160.

In another exemplary embodiment, the timing controller 120 may be a chip-type component, and although not shown in figures, the EEPROM 131 and the frame memory 132 may be disposed in the timing controller 120 as a type of chip.

Figure 5:
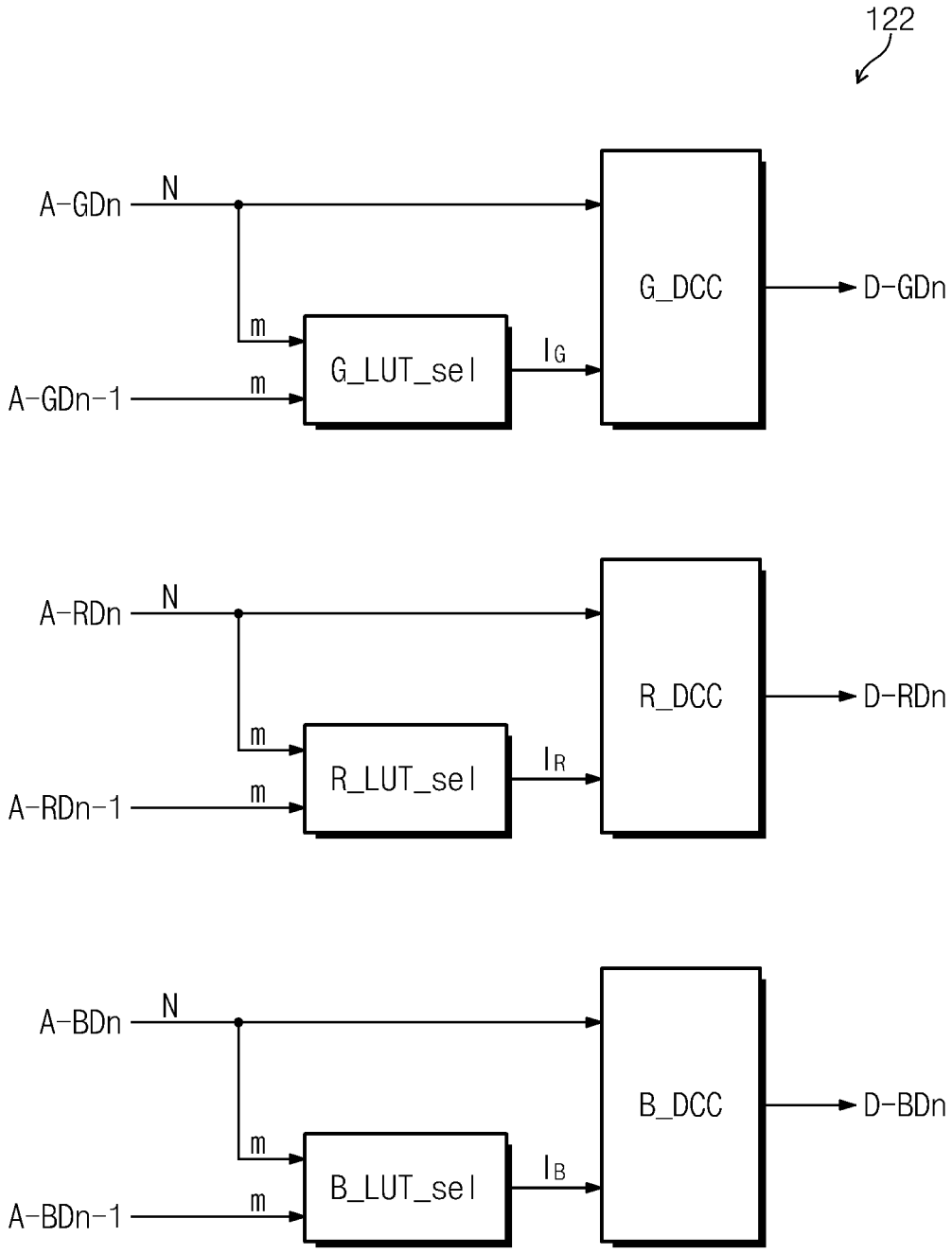
FIG. 5 is a block diagram of an exemplary embodiment of a dynamic capacitance capture ("DCC") block of the timing controller of FIG. 2.

FIG. 5 is a block diagram of an exemplary embodiment of the DCC of the timing controller of FIG. 2.

As shown in FIG. 5, the DCC block 122 includes a green data compensator G_DCC, a red data compensator R_DCC, and a blue data compensator B_DCC.

The green data compensator G_DCC selects a green look-up table, e.g., the selected green look-up table G_LUT_sel, corresponding to a sensed temperature among the green look-up tables, e.g., the first green look-up table to the m-th green look-up table G_LUT1 to G_LUTm, stored in the EEPROM 131 and compensates for the corrected green data A-GDn using the green correction value $I_G$ of the selected green look-up table G_LUT_sel.

The frame memory 132 shown in FIG. 1 stores N-bit data of the present image signal Gn and upper m-bit data of the previous image signal Gn-1 during one frame, where "m" is a natural number equal to or greater than "1" and "N" is a natural number greater than "m."

The selected green look-up table G_LUT_sel receives upper m-bit data of the corrected green data A-GDn of a present frame and m-bit data of corrected green data A-GDn-1 of a previous frame stored in the frame memory 132 and thereby outputs m-bit data of the green correction value $I_G$. Thus, the green data compensator G_DCC outputs N-bit data of the green compensation data D-GDn using the green correction value $I_G$ and lower bit data of the green data A-GDn of the present frame. In an exemplary embodiment, a gray scale level of the green compensation data D-GDn is higher than a gray scale level of the corrected green data A-GDn to improve the response speed.

The red data compensator R_DCC selects a red look-up table, e.g., the selected red look-up table R_LUT_sel, corresponding to the sensed temperature among the red look-up tables, e.g., the first red look-up table to the m-th red look-up table R_LUT1 to R_LUTm, and compensates for the corrected red data A-RDn using the red correction value $I_R$ of the selected red look-up table R_LUT_sel.

The selected red look-up table R_LUT_sel receives upper m-bit data of the corrected red data A-RDn of the present frame and m-bit data of corrected red data A-RDn-1 of the previous frame stored in the frame memory 132 to output m-bit data of the red correction value $I_R$. Thus, the red data compensator R_DCC outputs N-bit data of the red compensation data D-RDn using the red correction value $I_R$ and lower bit data of the corrected red data A-RDn of the present frame. In an exemplary embodiment, a gray scale level of the red compensation data D-RDn is higher than a gray scale level of the corrected red data A-RDn to improve the response speed.

The blue data compensator B_DCC selects a blue look-up table, e.g., the selected blue look-up table B_LUT_sel, corresponding to the sensed temperature among the blue look-up tables, e.g., the first blue look-up table to the m-th blue look-up table B_LUT1 to B_LUTm, and compensates for the corrected blue data A-BDn using the blue correction value $I_B$ of the selected blue look-up table B_LUT_sel.

The selected blue look-up table B_LUT_sel receives upper m-bit data of the corrected blue data A-BDn of the present frame and m-bit data of corrected blue data A-BDn-1 of the previous frame stored in the frame memory 132 to output m-bit data of the blue correction value $I_B$. The blue data compensator B_DCC outputs N-bit data of the blue compensation data D-BDn using the blue correction value $I_B$ and lower bit data of the corrected blue data A-BDn of the present frame. In an exemplary embodiment, a gray scale level of the blue compensation data D-BDn is higher than a gray scale level of the corrected blue data A-BDn to improve the response speed.

As described above, the DCC block 122 compensates for the response speed of each of the red, green and blue data A-RDn, A-GDn and A-BDn that are color-compensated by the ACC block 121 using the red, green and blue data compensators R_DCC, G_DCC and B_DCC, respectively, so that the response speed difference due to the gray scale difference of the corrected red, green and blue data A-RDn, A-GDn and A-BDn may be effectively prevented from occurring between the red, green and blue sub-pixels. As a result, the color blurring phenomenon occurred on the screen of the display apparatus 100 is effectively prevented.

Figure 6:
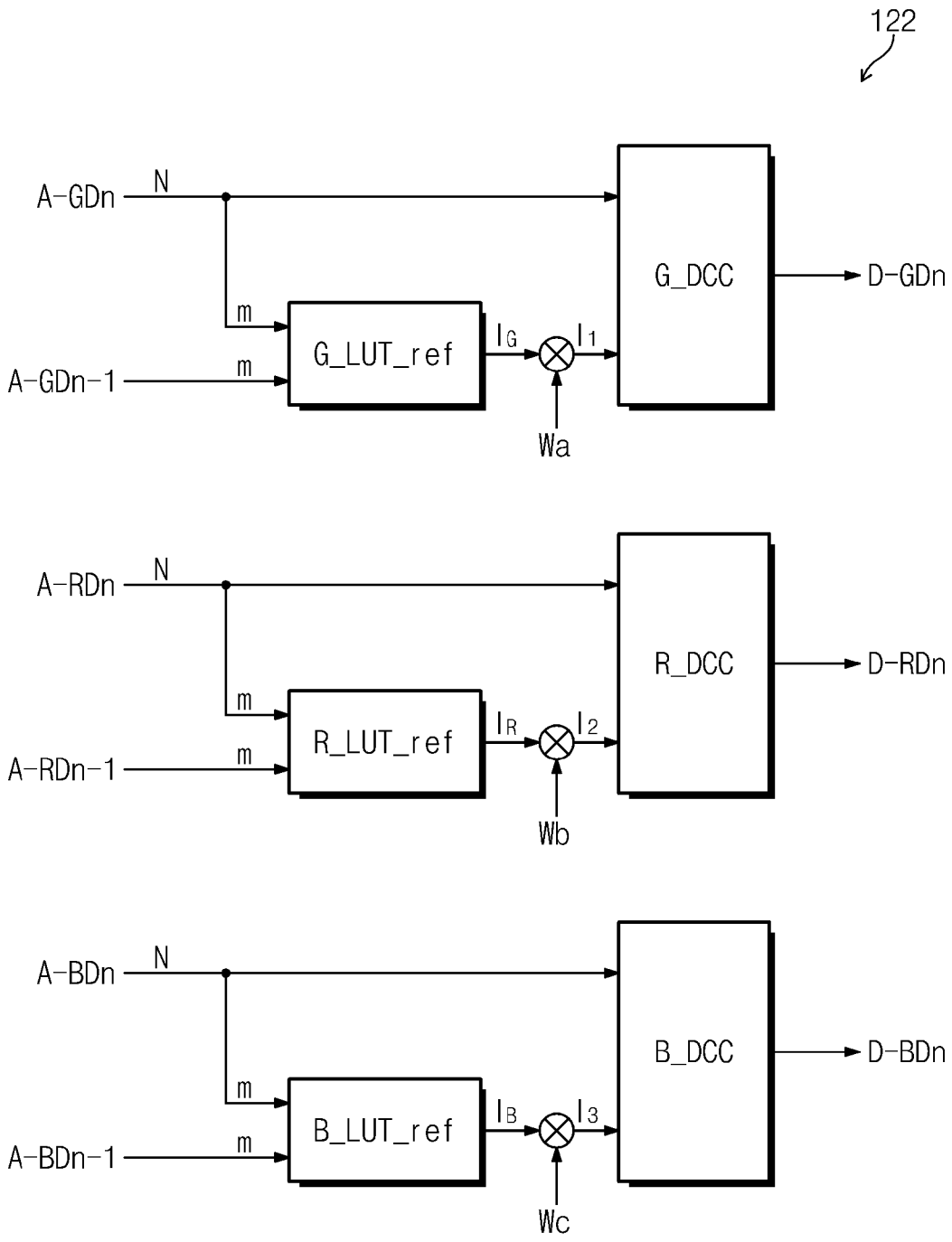
FIG. 6 is a block diagram of another exemplary embodiment of a DCC block of the timing controller of FIG. 2.

FIG. 6 is a block diagram of another exemplary embodiment of the DCC of the timing controller of FIG. 2.

In an exemplary embodiment, the EEPROM 131 may store a reference green look-up table G_LUT_ref, a reference red look-up table R_LUT_ref, and a reference blue look-up table B_LUT_ref therein. The reference green look-up table G_LUT_ref stores a green correction value corresponding to a reference temperature therein, the reference red look-up table R_LUT_ref stores a red correction value corresponding to the reference temperature therein, and the reference blue look-up table B_LUT_ref stores a blue correction value corresponding to the reference temperature therein. In an exemplary embodiment, the number of the look-up tables stored in the EEPROM 131 may be reduced to three, but not being limited thereto.

As shown in FIG. 6, the reference green look-up table G_LUT_ref receives upper m-bit data of the corrected green data A-GDn of a present frame and m-bit data of the corrected green data A-GDn-1 of a previous frame stored in the frame memory 132 and thereby outputs m-bit data of the green correction value $I_G$.

The reference red look-up table R_LUT_ref receives upper m-bit data of the corrected red data A-RDn of the present frame and m-bit data of the corrected red data A-RDn-1 of the previous frame stored in the frame memory 132 and thereby outputs m-bit data of the red correction value $I_R$.

The reference blue look-up table B_LUT_ref receives upper m-bit data of the corrected blue data A-BDn of the present frame and m-bit data of the corrected blue data A-BDn-1 of the previous frame stored in the frame memory 132 and thereby outputs m-bit data of the blue correction value $I_B$.

In an exemplary embodiment, the DCC block 122 includes a green data compensator G_DCC, a red data compensator R_DCC and a blue data compensator B_DCC.

The green data compensator G_DCC multiplies the green correction values $I_G$ output from the reference green look-up table G_LUT_ref by a first weight Wa varied according to the temperature sensed by the temperature sensor 110 in FIG. 1 and thereby generates a first correction value $I_1$. Accordingly, the green data compensator G_DCC may convert the corrected green data A-GDn into the green compensation data D-GDn based on the first correction value $I_1$.

The red data compensator R_DCC multiplies the red correction value $I_R$ output from the reference red look-up table R_LUT_ref by a second weight Wb varied according to the sensed temperature and thereby generates a second correction value $I_2$. Accordingly, the red data compensator R_DCC may convert the corrected red data A-RDn into the red compensation data D-RDn based on the second correction value $I_2$.

The blue data compensator B_DCC multiplies the blue correction value $I_B$ output from the reference blue look-up table B_LUT_ref by a third weight Wc varied according to the sensed temperature and thereby generates a third correction value $I_3$. Accordingly, the blue data compensator B_DCC may convert the corrected blue data A-BDn into the blue compensation data D-BDn based on the third correction value $I_3$.

In an exemplary embodiment, each of the first, second and third weights Wa, Wb and Wc decreases when the sensed temperature is higher than the reference temperature and increases when the sensed temperature is lower than the reference temperature.

Figure 7:
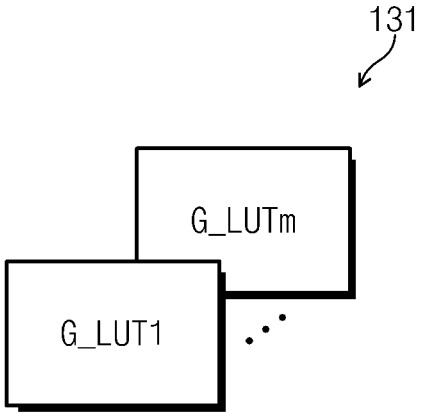
FIG. 7 is a plan view of another exemplary embodiment of an EEPROM of the display apparatus of FIG. 1.
Figure 8:
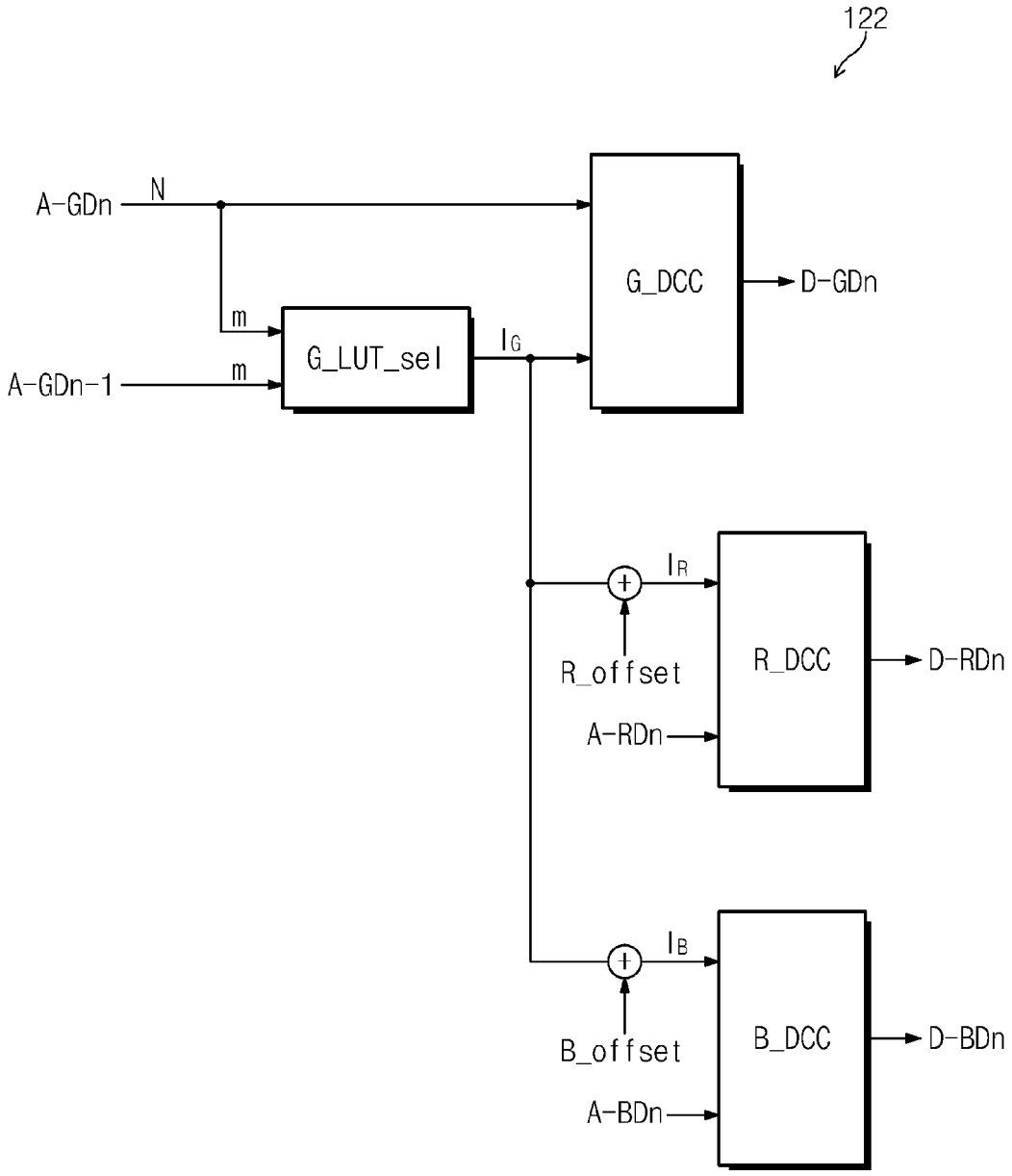
FIG. 8 is a block diagram of an exemplary embodiment of a DCC block that refers to look-up tables in the EEPROM of FIG. 7.
Figure 9:
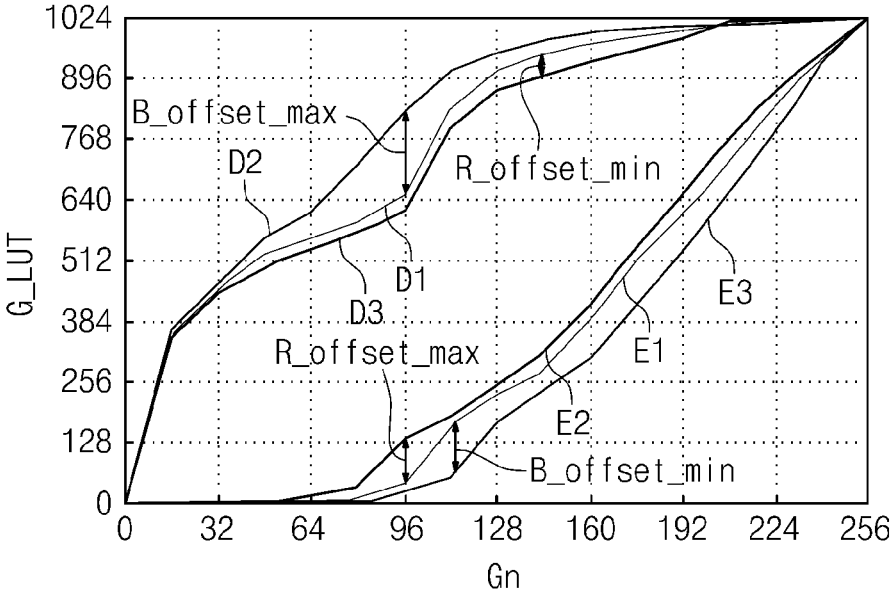
FIG. 9 is a graph of correction values versus gray scale values showing red and blue offsets of the DCC block of FIG. 8.

FIG. 7 is a plan view of another exemplary embodiment of the EEPROM of the display apparatus of FIG. 1, FIG. 8 is a block diagram of another exemplary embodiment of the DCC that refers to look-up tables in the EEPROM of FIG. 7, and FIG. 9 is a graph of correction values versus gray scale values showing red and blue offsets of the DCC of FIG. 8.

As shown in FIG. 7, an EEPROM 131 may include green look-up tables, e.g., the first green look-up table to the m-th green look-up table G_LUT1 to G_LUTm, each including a green correction value corresponding to different temperatures. In an exemplary embodiment, the EEPROM 131 may include four or eight green look-up tables. Accordingly, the timing controller 120 generates the selection signal Temp_sel corresponding to the temperature data Temp provided from the temperature sensor 110 and thereby selects one green look-up table (hereinafter referred to as "the selected green look-up table G_LUT_sel") among the green look-up tables, e.g., the first green look-up table to the m-th green look-up table G_LUT1 to G_LUTm included in the EEPROM 131.

Referring to FIG. 8, the selected green look-up table G_LUT_sel receives upper m-bit data of the green data A-GDn of a present frame and m-bit data of green data A-GDn-1 of a previous frame stored in the frame memory 132 and thereby outputs m-bit data of the green correction value $I_G$.

Referring again to FIG. 8, the DCC block 122 includes a green data compensator G_DCC, a red data compensator R_DCC and a blue data compensator B_DCC.

The green data compensator G_DCC outputs the green compensation data D-GDn based on the green compensation value $I_G$ and lower bit data of the green data A-GDn of the present frame.

The red data compensator R_DCC acquires red correction value $I_R$ by adding a red offset R_offset to the green correction value $I_G$ stored in the selected green look-up table G_LUT_sel and compensates for the red data A-RDn based on the red correction value $I_R$.

The blue data compensator B_DCC acquires blue correction values $I_B$ by adding a blue offset B_offset to the green correction value $I_G$ stored in the selected green look-up table G_LUT_sel and compensates for the blue data A-BDn based on the blue correction value $I_B$.

The selected green look-up table G_LUT_sel may further receive upper m-bit data of the red data A-RDn of the present frame and m-bit data of red data A-RDn-1 of the previous frame stored in the frame memory 132 and thereby output m-bit data of a red measuring value, and receive upper m-bit data of the blue data A-BDn of the present frame and m-bit data of blue data A-BDn-1 of the previous frame stored in the frame memory 132 and thereby output m-bit data of a blue measuring value.

In this case, the red offset R_offset is defined by a difference between the green correction value $I_G$ and the red measuring value, and the blue offset B_offset is defined by a difference between the green correction value $I_G$ and the blue measuring value.

Referring to FIG. 9, a fourth graph D1 and a fifth graph E1 represent the green correction value of the green look-up table according to the gray scale value of the present frame data, a sixth graph D2 and a seventh graph E2 represent the red measuring value of the green look-up table according to the gray scale value of the present frame data, and an eighth graph D3 and a ninth graphs E3 represent the blue measuring value of the green look-up table according to the gray scale value of the present frame data.

Referring again to FIG. 9, the red offset R_offset defined by the difference between the green correction value $I_G$ and the red measuring value may have a value in a range from a minimum red offset R_offset_min (for example, about −40) to a maximum red offset R_offset_max (for example, about 96). The blue offset B_offset defined by the difference between the green correction value $I_G$ and the blue measuring value may have a value in a range from a minimum blue offset B_offset_min (for example, about −108) to a maximum blue offset B_offset_max (for example, about 176).

In an exemplary embodiment, the red and blue offsets R_offset and B_offset may be converted to 8-bit data (from about −127 to about +128) or 10-bit data (from about −511 to about +512) to be added to the green correction value $I_G$. Accordingly, each of the red and blue offsets R_offset and B_offset may be in 8-bit set, e.g., from −127 to +128, or in 10-bit set, e.g., from −511 to +512.

Figure 10:
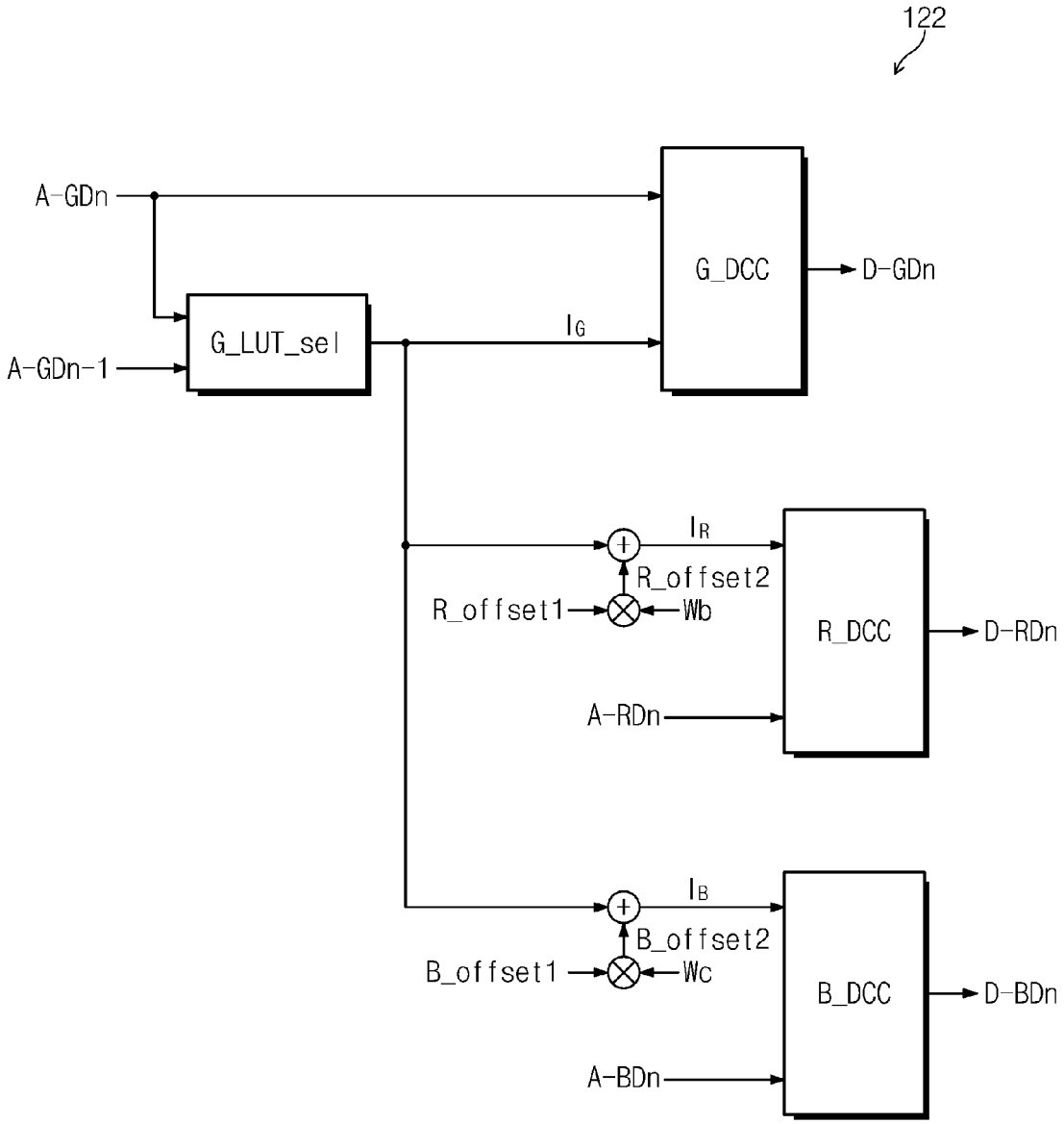
FIG. 10 is a block diagram of another exemplary embodiment of a DCC block that refers to the look-up tables in the EEPROM of FIG. 7.

FIG. 10 is a block diagram of another exemplary embodiment of the DCC that refers to the look-up tables in the EEPROM of FIG. 7.

Since the DCC block 122 shown in FIG. 10 refers to the look-up tables in the EEPROM 131 of FIG. 7, the timing controller 120 generates the selection signal Temp_sel corresponding to the temperature data Temp provided from the temperature sensor 110 and selects one green look-up table, e.g., the selected green look-up table G_LUT_sel, among the green look-up tables, e.g., the first green look-up table to the mi-th green look-up table G_LUT1 to G_LUTm, included in the EEPROM 131. The selected green look-up table G_LUT_sel receives upper m-bit data of the green data A-GDn of a present frame and m-bit data of green data A-GDn-1 of a previous frame stored in the frame memory 132 and outputs an m-bit green correction value $I_G$.

In addition, the selected green look-up table G_LUT_sel receives upper m-bit data of the red data A-RDn of the present frame and m-bit data of red data A-RDn-1 of the previous frame stored in the frame memory 132 and thereby outputs an m-bit red measuring value, and receives upper m-bit data of the blue data A-BDn of the present frame and m-bit data of blue data A-BDn-1 of the previous frame stored in the frame memory 132 and thereby outputs an m-bit blue measuring value.

Referring to FIG. 10, the green data compensator G_DCC of the DCC block 122 outputs N-bit data of the green compensation data D-GDn based on the green correction value $I_G$ and lower bit data of the green data A-GDn of the present frame.

The red data compensator R_DCC generates a second red offset R_offset2 by multiplying a first red offset R_offset1 by a red weight Wb, and acquires the red correction value $I_R$ by adding the second red offset R_offset2 to the green correction value $I_G$. In this case, the first red offset R_offset1 is defined by a difference between the green correction value $I_G$ and the red measuring value. In addition, the red weight Wb may be varied according to the level of the temperature data Temp. Accordingly, the red data compensator R_DCC outputs N-bit data of the red compensation data D-RDn based on the red correction value $I_R$ and the lower bit data of the red data A-RDn of the present frame.

The blue data compensator B_DCC generates a second blue offset B_offset2 by multiplying a first blue offset B_offset1 by a blue weight Wc, and acquires the blue correction value $I_B$ adds the second blue offset B_offset2 to the green correction value $I_G$. In this case, the first blue offset B_offset1 is defined by a difference between the green correction value $I_G$ and the blue measuring value. In addition, the blue weight Wb may be varied according to the level of the temperature data Temp. Accordingly, the blue data compensator B_DCC outputs N-bit data of the blue compensation data D-BDn based on the blue correction value $I_B$ and the lower bit data of the blue data A-BDn of the present frame.

Figure 11:
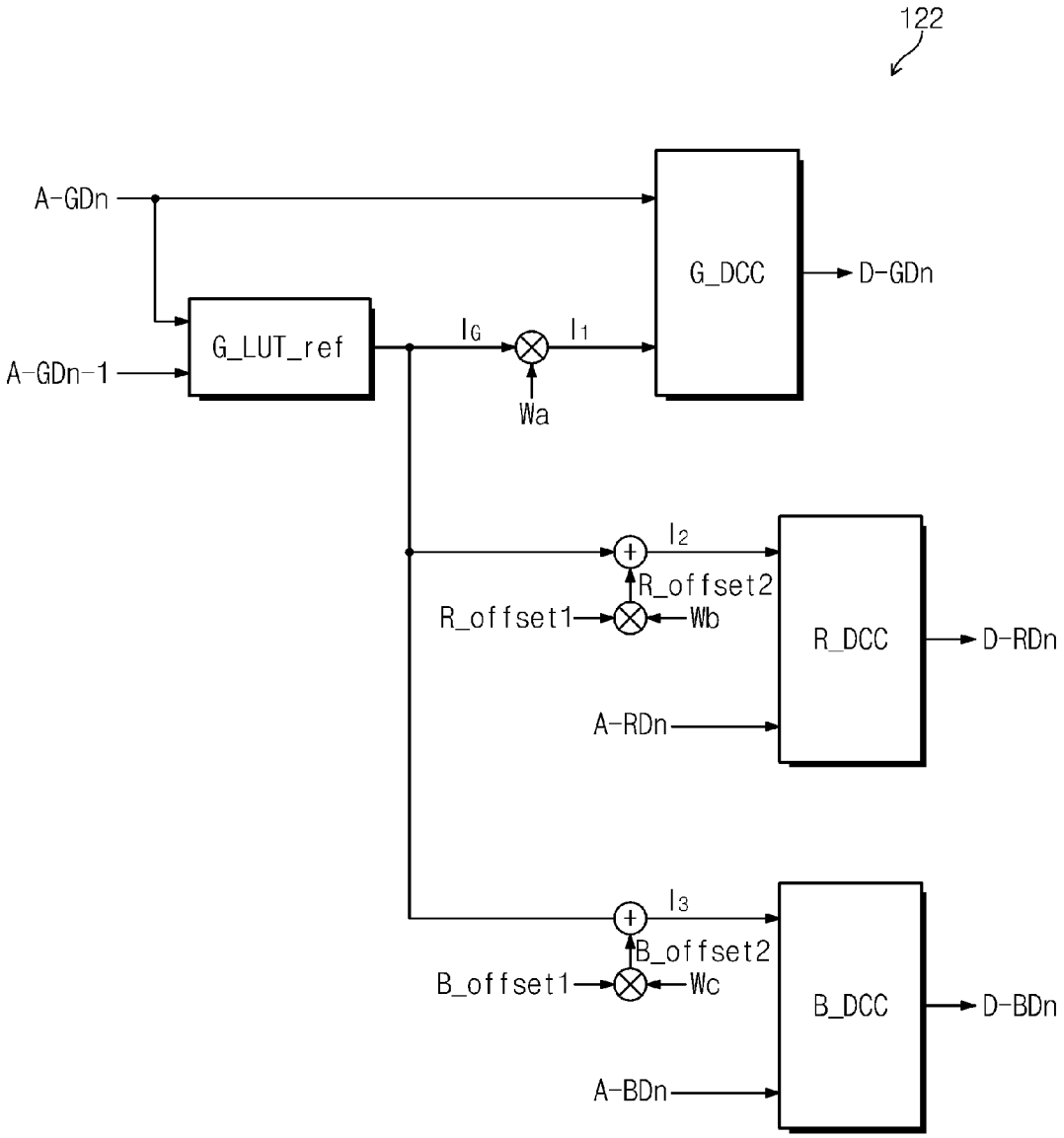
FIG. 11 is a block diagram of another exemplary embodiment of a DCC block of the timing controller of FIG. 2.

FIG. 11 is a plan view of another exemplary embodiment of the DCC.

Figure 12:
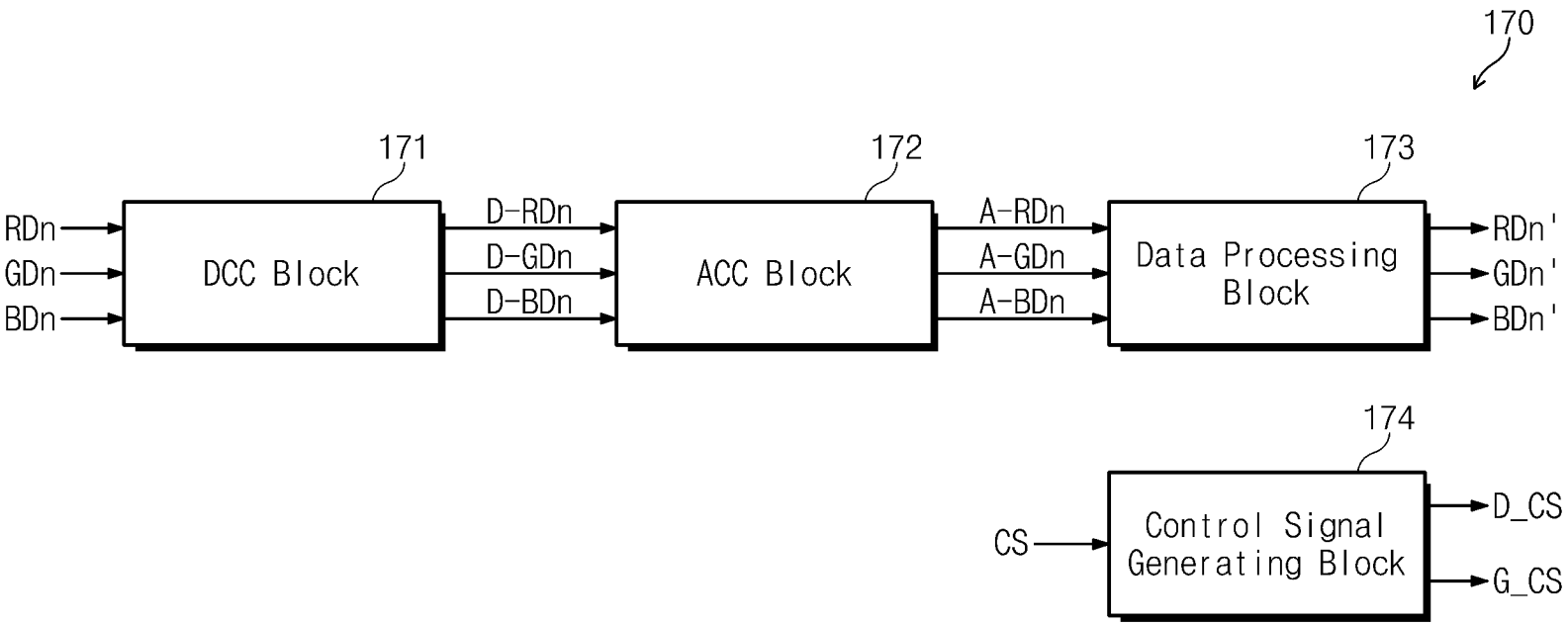
FIG. 12 is a block diagram of another exemplary embodiment of a timing controller of the display apparatus of FIG. 1.

The DCC block 122 shown in FIG. 12 may refer to the look-up tables in the EEPROM 131, e.g., a reference green look-up table G_LUT_ref determined corresponding to a reference temperature. In an exemplary embodiment, the reference green look-up table G_LUT_ref receives upper m-bit data of the green data A-GDn of a present frame and m-bit data of green data A-GDn-1 of a previous frame stored in the frame memory 132, and outputs m-bit data of the green correction values $I_G$.

Referring to FIG. 11, the DCC block 122 includes a green data compensator G_DCC, a red data compensator R_DCC and a blue data compensator B_DCC.

The green data compensator G_DCC generates a first correction value $I_1$ by multiplying the green correction value $I_G$ output from the reference green look-up table G_LUT_ref by a first weight Wa determined based on the temperature data Temp provided from the temperature sensor 110 shown in FIG. 1. Accordingly, the green data compensator G_DCC may convert the corrected green data A-GDn into the green compensation data D-GDn based on the first correction value $I_1$.

The red data compensator R_DCC generates a second red offset R_offset2 by multiplying a first red offset R_offset1 by a second weight Wb and acquires the red correction value $I_R$ by adding the second red offset R_offset2 to the green correction values $I_G$. In this case, the first red offset R_offset1 is defined by a difference between the green correction value $I_G$ and the red measuring value. In addition, the second weight Wb may be varied according to the level of the temperature data Temp. Accordingly, the red data compensator R_DCC may convert the corrected red data A-RDn into the red compensation data D-RDn based on the red correction value $I_R$.

The blue data compensator B_DCC generates a second blue offset B_offset2 by multiplying a first blue offset B_offset1 by a third weight Wc and acquires the blue correction values $I_B$ by adding the second blue offset B_offset2 to the green correction value $I_G$. In this case, the first blue offset B_offset1 is defined by a difference between the green correction value $I_G$ and the blue measuring value. In addition, the third weight Wb may be varied according to the level of the temperature data Temp. Accordingly, the blue data compensator B_DCC may convert the corrected blue data A-BDn into the blue compensation data D-BDn based on the blue correction value $I_B$.

As described above, the DCC block 122 compensates for the response speed of each of the corrected red, green and blue data A-RDn, A-GDn and A-BDn, which are color-compensated by the ACC block 121, through the red, green and blue data compensators R_DCC, G_DCC and B_DCC, respectively, so that the response speed difference between the red, green and blue sub-pixels due to the gray scale difference of the corrected red, green and blue data A-RDn, A-GDn and A-BDn is effectively prevented. Accordingly, the color blurring phenomenon on the screen of the display apparatus 100 is effectively prevented.

In an exemplary embodiment, the number of the look-up tables included in the EEPROM 131 may vary according to the structure of the DCC block 122 shown in FIGS. 5 to 11. That is, as the number of the look-up tables decreases, the size of the EEPROM 131 is effectively reduced.

FIG. 12 is a block diagram of another exemplary embodiment of the timing controller of the display apparatus of FIG. 1. The same or like elements shown in FIG. 12 have been labeled with the same reference characters as used above to describe the exemplary embodiments of the timing controller shown in FIG. 2, and any repetitive detailed description thereof will hereinafter be omitted or simplified.

Referring to FIG. 12, the timing controller 170 includes a DCC block 171, an ACC block 172, a data processing block 173 and a control signal generating block 174. The timing controller 170 in FIG. 12 is substantially the same as the timing controller 120 shown in FIG. 2 except that the DCC block 171 is referenced prior to the ACC block 172.

An exemplary embodiment of the DCC block 171 shown in FIG. 12 may be one of the exemplary embodiments of the DCC blocks shown in FIGS. 5 to 11. In The DCC block 171 of FIG. 12, the color compensation is performed by the ACC block 172 after compensating for the response speed with respect to each of the red, green and blue data RDn, GDn and BDn. Accordingly, although the red, green and blue data A-RDn, A-GDn and A-BDn color-compensated by the ACC block 172 are provided to the display panel 160, the response speed difference between the red, green and blue sub-pixels is effectively prevented.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display apparatus comprising:

a temperature sensor which senses a temperature;

a timing controller, including a dynamic capacitance capture block, which converts a green data, a red data and a blue data into a green compensation data, a red compensation data and a blue compensation data, respectively, based on the temperature sensed by the temperature sensor;

green look-up tables including green compensation values different from one another and corresponding to predetermined temperatures;

a data driver which converts the red compensation data, the green compensation data and the blue compensation data into a data voltage and outputs the data voltage; and a display panel which receives the data voltage and displays an image, wherein the dynamic capacitance capture block comprises:

a green data compensator which selects a green look-up table corresponding to the temperature sensed by the temperature sensor among the green look-up tables and compensates for the green data based on a green compensation value of the green look-up table selected thereby, a red data compensator which generates a red compensation value by multiplying the green compensation value in the green look-up table selected by the green data compensator by a red offset and compensates for the red data based on the red compensation value; and a blue data compensator which acquires a blue compensation value by multiplying the green compensation value in the green look-up table selected by the green data compensator by a blue offset and compensates for the blue data based on the blue compensation value, and wherein the dynamic capacitance capture block compensates for the red data and the blue data based on the green compensation value.

2. The display apparatus of claim 1, further comprising an electrically erasable programmable read-only memory comprising the green look-up tables including green compensation values different from one another and corresponding to predetermined temperatures.

3. The display apparatus of claim 1, further comprising a frame memory which stores N-bit data of a present frame data and upper m-bit data of a previous frame data during one frame, wherein m is a natural number equal to or greater than one, N is a natural number greater than m, the green look-up table receives upper m-bit data of a green data of a present frame and m-bit data of a green data of a previous frame stored in the frame memory and outputs m-bit data of the green compensation value, the green look-up table receives upper m-bit data of a red data of the present frame and m-bit data of a red data of the previous frame stored in the frame memory and outputs m-bit data of a red measuring value, and the green look-up table receives upper m-bit data of a blue data of the present frame and m-bit data of a blue data of the previous frame stored in the frame memory and outputs m-bit data of a blue measuring value.

4. The display apparatus of claim 1, wherein the red offset is defined by a difference between the green compensation value and the red measuring value, and the blue offset is defined by a difference between the green compensation value and the blue measuring value.

5. The display apparatus of claim 1, wherein the red offset is defined by a value acquired by multiplying the difference between the green compensation value and the red measuring value by a red weight predetermined according to the temperature sensed by the sensing sensor, and the blue offset is defined by a value acquired by multiplying the difference between the green compensation value and the red measuring value by a blue weight predetermined according to the temperature sensed by the sensing sensor.

6. The display apparatus of claim 1, wherein the timing controller further comprises an accurate color capture block which gamma corrects the red data, the green data and the blue data based on a gamma correction value and generates corrected red data, corrected green data and corrected blue data, and the dynamic capacitance capture block receives the corrected red data, the corrected green data and the corrected blue data corrected by the accurate color capture block.

7. The display apparatus of claim 1, wherein the timing controller further comprises an accurate color capture block which gamma corrects the red data, the green data and the blue data output from the dynamic capacitance capture block based on a gamma correction value and generates corrected red data, corrected green data and corrected blue data.

8. A display apparatus comprising:

a temperature sensor which senses a temperature;

a timing controller, including a dynamic capacitance capture block, which converts a green data, a red data and a blue data into a green compensation data, a red compensation data and a blue compensation data, respectively, based on the temperature sensed by the temperature sensor;

green look-up tables including green compensation values different from one another and corresponding to predetermined temperatures;

a data driver which converts the red compensation data, the green compensation data and the blue compensation data into a data voltage and outputs the data voltage; and a display panel which receives the data voltage and displays an image, wherein the dynamic capacitance capture block comprises:

a green data compensator which selects a green look-up table corresponding to the temperature sensed by the temperature sensor among the green look-up tables and compensates for the green data based on a green compensation value of the green look-up table selected thereby, wherein the dynamic capacitance capture block further comprises:

the green data compensator which generates a first compensation value by multiplying the green compensation value by a first weight determined according to the temperature sensed by the sensing sensor and compensates for the green data based on the first compensation value;

a red data compensator which generates a second red offset by multiplying a first red offset by a second weight predetermined according to the temperature sensed by the sensing sensor, generates a second compensation value by multiplying the green compensation value by the second red offset and compensates for the red data based on the second compensation value; and a blue data compensator which generates a second blue offset multiplies a first blue offset by a third weight predetermined according to the temperature sensed by the sensing sensor, generates a third compensation value by multiplying the green compensation value by the second blue offset and compensates for the blue data based on the third compensation value.

9. The display apparatus of claim 8, further comprising an electrically erasable programmable read-only memory comprising a green look-up table of the green look-up tables which includes a green compensation value corresponding to a reference temperature.

10. The display apparatus of claim 8, further comprising a frame memory which stores N-bit data of a present frame data and upper m-bit data of a previous frame data during one frame, wherein m is a natural number greater than or equal to one, N is a natural number larger than m, the green look-up table receives upper m-bit data of a green data of a present frame and m-bit data of a green data of a previous frame stored in the frame memory and outputs m-bit data of the green compensation value, the green look-up table receives upper m-bit data of a red data of the present frame and m-bit data of a red data of the previous frame stored in the frame memory and outputs m-bit data of the red measuring value, and the green look-up table receives upper m-bit data of a blue data of the present frame and m-bit data of a blue data of the previous frame stored in the frame memory and outputs m-bit data of the blue measuring value.

11. The display apparatus of claim 10, wherein the first red offset is defined by a difference between the green compensation value and the red measuring value, the first blue offset is defined by a difference between the green compensation value and the blue measuring value, the second red offset is defined by a value acquired by multiplying the first red offset by the second weight, and the second blue offset is defined by a value acquired by multiplying the first blue offset by the third weight.

12. A method of driving a display apparatus, the method comprising:

sensing a temperature;

storing green compensation values different from one another and corresponding to predetermined temperatures in green look-up tables;

converting a green data, a red data, and a blue data into a green compensation data, a red compensation data and a blue compensation data, respectively, based on the temperature;

converting the red compensation data, the green compensation data and the blue compensation data into a data voltage; and receiving the data voltage and displaying an image based on the data voltage;

wherein the converting a green data, a red data, and a blue data comprises:

selecting a green look-up table corresponding to the temperature sensed by a temperature sensor among the green look-up tables and compensating for the green data based on a green compensation value of the green look-up table selected thereby;

generating a red compensation value by multiplying the green compensation value in the selected green look-up table by a red offset and compensating for the red data based on the red compensation value;

generating a blue compensation value by multiplying the green compensation value in the selected green look-up table by a blue offset and compensating for the blue data based on the blue compensation value.

* * * * *